US008162515B2

(12) United States Patent
Graham

(10) Patent No.: US 8,162,515 B2
(45) Date of Patent: Apr. 24, 2012

(54) LIGHTING DEVICE

(76) Inventor: Morton Graham, Bolton (GB)

( * ) Notice: Subject to any disclaimer, the term of this patent is extended or adjusted under 35 U.S.C. 154(b) by 0 days.

(21) Appl. No.: 12/413,921

(22) Filed: Mar. 30, 2009

(65) Prior Publication Data

US 2009/0207608 A1 Aug. 20, 2009

Related U.S. Application Data

(63) Continuation of application No. PCT/GB2007/003834, filed on Oct. 10, 2007.

(30) Foreign Application Priority Data

Oct. 11, 2006 (GB) ..... 0620096.8

(51) Int. Cl.
*F21S 8/00* (2006.01)

(52) U.S. Cl. ..... 362/368; 362/249.02; 362/364; 362/133; 362/147

(58) Field of Classification Search ..... 362/368, 362/373, 145, 147, 146, 133, 148, 249.02, 362/300, 301, 311.02, 343, 364
See application file for complete search history.

(56) References Cited

U.S. PATENT DOCUMENTS 3,643,085 A * 2/1972 Durand ..... 362/97.1
3,790,772 A * 2/1974 Newman et al. ..... 40/444
4,562,517 A * 12/1985 Pankin ..... 362/147
6,976,765 B2 * 12/2005 Helenowski ..... 362/147
7,165,863 B1 * 1/2007 Thomas et al. ..... 362/219
2005/0024856 A1 2/2005 Helenowski

FOREIGN PATENT DOCUMENTS

DE 202004019151 U1 4/2005
WO 02/055789 A 7/2002

* cited by examiner

*Primary Examiner* — Sharon Payne
(74) *Attorney, Agent, or Firm* — Gesmer Updegrove LLP

(57) ABSTRACT

A lighting device (10) for use within a light box or light panel and comprising a housing with generally parallel upper and lower walls (11, 12) and diverging side walls (13, 14) with one or more LEDs (18) disposed within the housing on a back wall (15) thus to project light outwardly from the housing. Several such devices may be disposed within a light box or light panel to project light across the latter which light is then diffused before exiting from a front display panel or the like. The diffused light conceals the lighting devices within the light box or light panel. Such devices are intended to replace conventional fluorescent or neon lighting tubes or tungsten lights to produce substantially uniform light distribution by diffusion within the light box or light panel and incorporating low voltage and low power consuming light sources.

17 Claims, 2 Drawing Sheets

LIGHTING DEVICE

PRIORITY INFORMATION

This application is a continuation of International Application No. PCT/GB2007/003834 filed on Oct. 10, 2007 which claims priority to Great Britain Patent Application No. 0620096.8 filed on Oct. 11, 2006, all of which are incorporated by reference in their entirety herein.

BACKGROUND OF THE INVENTION

1. Field of the Invention

This invention concerns a light box having a base, side walls and a translucent front wall, with a light fixed to the base spaced from the front wall and from the side walls, wherein the light comprises a plurality of lighting devices. The light box may serve as a display panel, or an illumination panel for room lighting.

2. Brief Description of the Prior Art

There is increasing interest, in lighting devices, in the use of light emitting diodes (LEDs) which are low voltage devices with low power consumption yet producing, in many cases, sufficient brilliance to replace conventional fluorescent or neon tube lighting or tungsten lighting.

SUMMARY OF THE INVENTION

It is an object of the present invention to enhance the light emitting properties of one or more LEDs to illuminate the interior, for example, of a light box, display panel or ceiling lighting tile or panel.

According to the present invention there is provided a light box having a base, side walls and a translucent front wall, a light fixed to the base spaced from the front wall and from the side walls, the light comprising a plurality of lighting devices each_lighting device comprising an open-fronted housing defined by upper and lower spaced walls and diverging side walls, at least one LED disposed in the housing remote from its open front, and electrical supply means for the or each LED wherein the open fronted housing faces the side walls of the light box so that light from the or each LED is reflected off the base and side walls of the light box before transmission through the translucent front wall, whereby light is diffused within the light box before transmission through the translucent front wall and so that the lighting device is substantially concealed thereby;

wherein the diverging side walls of each lighting device are generally straight;

wherein the diverging side walls of each lighting device extend from a back wall of the device; and wherein the lower wall is triangular with the angle of the lower wall at the corner enabling a plurality of said lighting devices to be fitted to said base in a formation to radiate light in multiple directions, said side walls of adjacent ones of said lighting devices being contiguous.

The upper and lower spaced walls may be substantially parallel.

The diverging side walls may be substantially define a right angle.

The back wall may be substantially parallel to the open front of the housing.

Means may be provided for attachment of the device to a surface.

The attachment means may be a rearward extension of the lower wall with an aperture for receiving a pin, stud or screw.

At least some of the interior wall surfaces of the housing may be light-coloured to reflect light from the or each LED.

At least one exterior wall surface of the housing may be light-coloured to reflect diffused light issuing from the device.

The diverging side walls may be curved.

The housing may be predominantly of metal to dissipate heat from the or each LED.

The light box or light panel may be of rectangular or polygonal shape with two or more such lighting devices located in two or more corners thereof to project light across the light box or light panel for diffusion therewithin.

BRIEF DESCRIPTION OF THE DRAWINGS

Embodiments of the invention will now be described, by way of example only, with reference to the accompanying schematic drawings, in which.

DETAILED DESCRIPTION OF THE INVENTION

Figure 1:
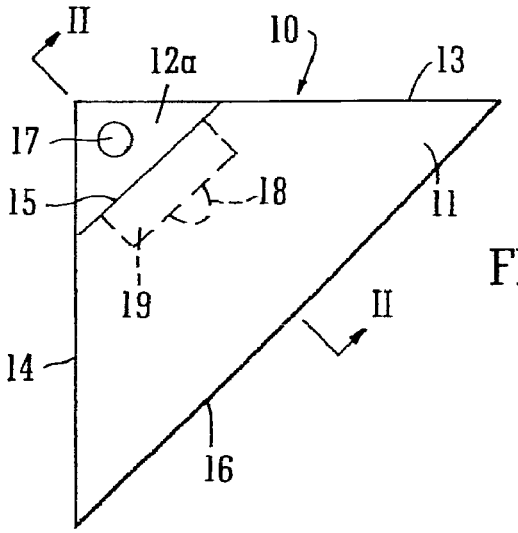
FIG. 1 is a plan view of a lighting device made in accordance with the invention.
Figure 2:
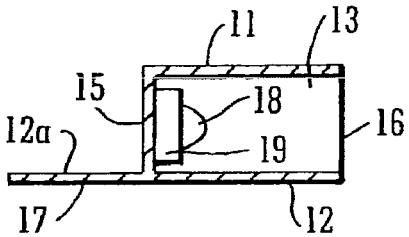
FIG. 2 is a cross-section taken on line 2-2 of FIG. 1.

Referring now to the drawings, a lighting device comprises an open fronted housing 10 defined by upper and lower generally parallel walls 11, 12 and diverging side walls 13, 14 which together define a right angle and a back wall 15 generally parallel to the open front 16 of the device. A rearward continuation of the lower wall 12 forms an attachment tab 12*a* with an aperture 17 to receive a pin, stud or screw.

Fixedly attached to the inner surface of the back wall 15 within the housing 10 is an LED 18 on an electrical supply circuit board 19. A supply lead (not shown) will be connected to the board 19 to power the LED 18. Instead of a single LED 18 an array of such LEDs may be provided on the board 19.

The housing 10 may be of plastics with the board 19 consisting of an aluminium plate attached to a further metal plate which acts to dissipate the heat generated by the LED 18 in use. All interior surfaces of the housing 10 are preferably coated with a white or light coloured paint thus to reflect light from the LED 18 outwardly from the open front 16 of the housing.

The exterior surface of the upper wall 13 is also similarly light-coloured.

Figure 3:
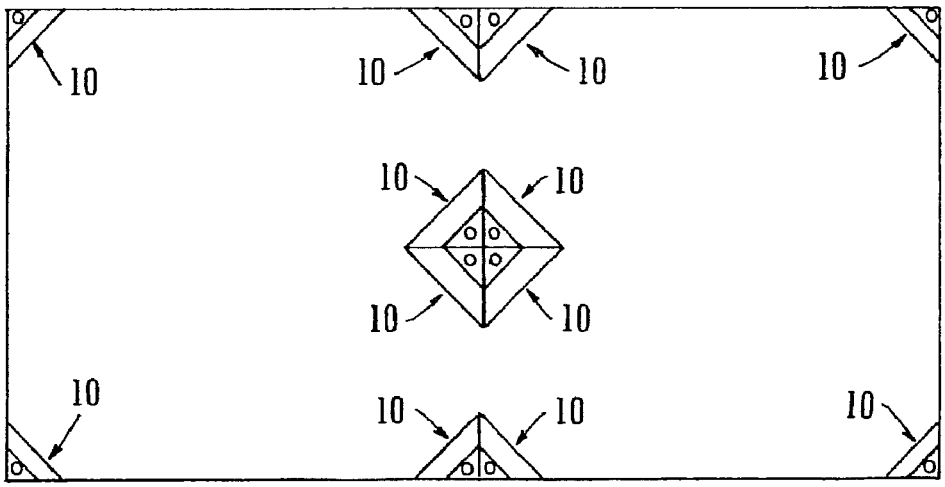
FIG. 3 is a plan view of a light box or light panel incorporating several such devices.
Figure 4:
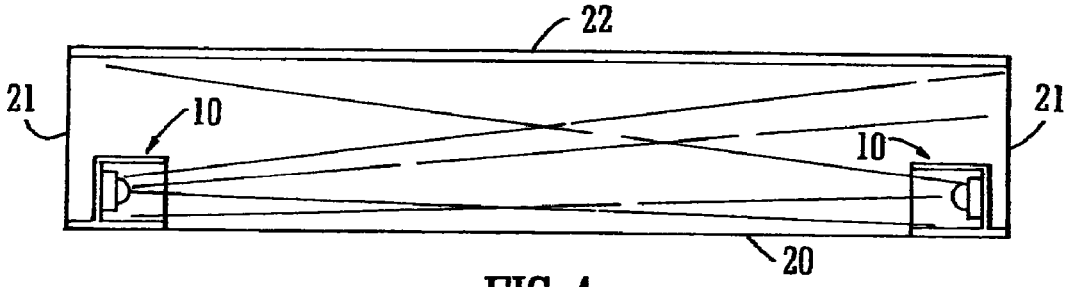
FIG. 4 is a cross-sectional diagonal view of a light box or light panel incorporating such devices.

Referring now to FIG. 3, in one embodiment, four such lighting devices are enclosed within a rectangular light box or light panel so that each device projects light outwardly across the interior of the panel. The panel, as illustrated in FIG. 4, will have an opaque base 20 and shallow side walls 21 with a translucent top 22 which may carry a graphic, such as an advertising display, to be illuminated from within the panel.

The depth of each lighting device 10 may be in the region of 10 mm while the depth of the light panel defined by the walls 21 may be in the region of 25 mm, such that the panel has a depth less than three times that of each device 10. In some cases, however, the panel can be of considerably greater depth than the devices 10.

In use, light is projected from each lighting device into the light panel where it is diffused before exiting through the translucent front wall 22. The diffused light conceals the upper surface of each lighting device 10 so that a substantially uniform light distribution across the front wall 22 is achieved, while the lighting devices 10 are effectively concealed by the diffused light, and by the reflective nature of the light-coloured coating on the tops of the devices.

As shown in FIG. 3, in addition to such devices disposed in each of the four corners of a rectangular panel additional such devices may be provided centrally and/or part-way along the sides, particularly in large panels, in order to ensure a uniform distribution of the light exiting the front wall 22.

Figure 5:
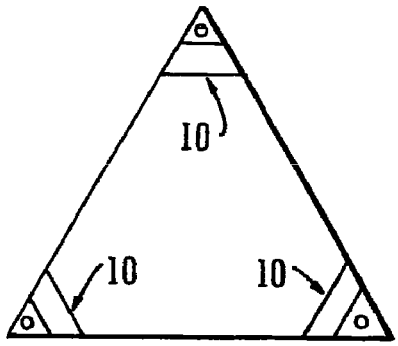
FIG. 5 is a plan view of a triangular light box or light panel incorporating three such devices.

Referring now to FIG. 5, an example is shown of a triangular lighting panel with lighting devices in the three corners.

Figure 6:
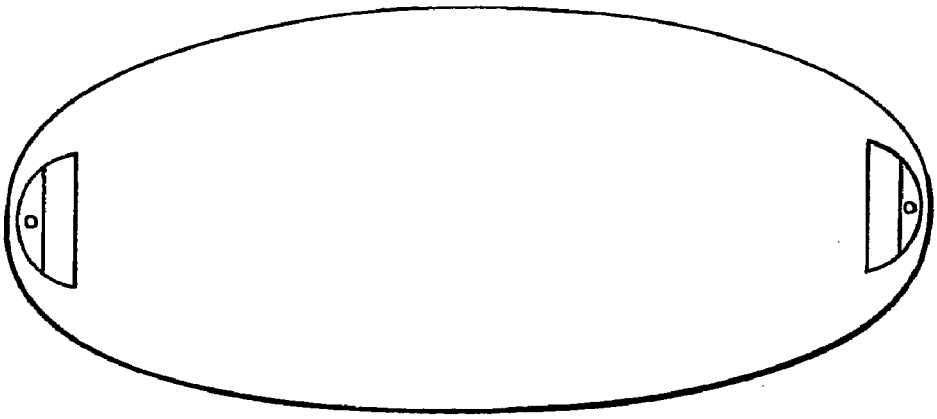
FIG. 6 is a plan view of an elliptical light box or light panel incorporating two such devices.

FIG. 6 shows an example of an elliptical panel with two such devices at opposed ends. In this case, the diverging walls of each device are of a curved configuration. Any shape of panel may be provided with such devices located and deployed appropriately within the interior of the enclosed panel.

These panels can be used either for display purposes such as for commercial advertising or for ceiling lighting tiles for room illumination.

It is not intended to limit the invention to the above example only. For example, the upper and lower walls 11 and 12 may themselves be of diverging form to ensure adequate spread of the light issuing from the open front 16 of the device.

Furthermore, a number of such devices may be used for concealed lighting such as under cupboards and in display cabinets where they would be concealed by an opaque panel to avoid direct visibility of the LEDs themselves, the illumination being provided by the diffused light issuing from the open fronts 16 of the devices.

What is now claimed:

1. A light box having a base, side walls and a translucent front wall, a light fixed to the base spaced from the front wall and from the side walls, the light comprising a plurality of lighting devices each device comprising;

an open fronted housing defined by upper and lower spaced walls and diverging side walls, at least one LED disposed in the housing remote from its open front, and electrical supply means for the or each LED;

wherein the open fronted housing faces the side walls of the light box so that light from each LED is reflected off the base and side walls of the light box before transmission through the translucent front wall whereby light is diffused within the light box before transmission through the translucent front wall and so that the LED is substantially concealed thereby;

wherein the diverging side walls of each lighting device are generally straight;

wherein the diverging side walls of each lighting device extend from a back wall of the device; and wherein the lower wall is triangular and a plurality of said lighting devices are fitted to said base in a formation to radiate light in multiple directions, said side walls of adjacent ones of said lighting devices being contiguous.

2. The light box according to claim 1, wherein the upper and lower spaced walls of the lighting device are substantially parallel.

3. The light box according to claim 1, wherein the diverging side walls of the lighting device are generally straight and substantially define aright angle between them.

4. The light box according to claim 1, wherein the diverging side walls of the lighting device extend from a back wall which is substantially parallel to the open front of the housing.

5. The light box according to claim 1, wherein the lighting device includes means for attachment of the device to a surface.

6. The light box according to claim 5, wherein the attachment means is a rearward extension of the lower wall with an aperture for receiving a pin, stud or screw for reception in the base.

7. The light box according to claim 1, wherein at least some of the interior wall surfaces of the housing of the lighting device are light-coloured to reflect light from the or each LED.

8. The light box according to claim 1, wherein at least one exterior wall surface of the housing of the lighting device is light-coloured to reflect diffused light issuing from the device and reflected internally within the light box prior to transmission through the translucent or transparent front wall.

9. The light box according to claim 1, wherein the diverging side walls of the lighting device are curved.

10. The light box according to claim 1, wherein the housing is of plastics with an insert of metal to dissipate heat from the or each LED.

11. The light box according to claim 1, wherein the light box or light panel has a depth less than three times that of the lighting device.

12. The light box according to claim 11, which is of rectangular or polygonal shape with two or more such lighting devices located in two or more corners thereof to project light across the light box or light panel for diffusion therewithin.

13. The light box according to claim 12, wherein the lighting device includes means for attachment of the device to a surface; and the attachment means is a rearward extension of the lower wall with an aperture for receiving a pin, stud or screw for reception in the base.

14. The light box according to claim 13, wherein the lower wall is triangular with the angle of the lower wall at the corner comprising said extension being the same as an angle between side walls of the light box, said lighting device being fitted abutting said side walls.

15. The light box according to claim 14, wherein the lower wall is triangular with the angle of the lower wall at the corner comprising said extension being a right angle and four of said lighting devices being fitted to said base in a square formation to radiate light in multiple directions.

16. The light box according to claim 1, wherein the lighting device includes means for attachment of the device to a surface; and the attachment means is a rearward extension of the lower wall with an aperture for receiving a pin, stud or screw for reception in the base.

17. The light box according to claim 16, wherein the lower wall is triangular with the angle of the lower wall at the corner comprising said extension being a right angle and four of said lighting devices being fitted to said base in a square formation to radiate light in multiple directions.

* * * * *